US006589112B2

(12) United States Patent
Ruach

(10) Patent No.: US 6,589,112 B2
(45) Date of Patent: Jul. 8, 2003

(54) DUCT SILENCER

(76) Inventor: Evan Ruach, 125 Justice Dr., East Peoria, IL (US) 61611

( * ) Notice: Subject to any disclaimer, the term of this patent is extended or adjusted under 35 U.S.C. 154(b) by 0 days.

(21) Appl. No.: 10/026,005

(22) Filed: Dec. 21, 2001

(65) Prior Publication Data

US 2002/0115406 A1 Aug. 22, 2002

Related U.S. Application Data

(60) Provisional application No. 60/258,862, filed on Dec. 29, 2000.

(51) Int. Cl.[7] ..... F24F 13/24

(52) U.S. Cl. ..... 454/276; 181/224; 454/254; 454/906

(58) Field of Search ..... 454/224, 254, 454/271, 276, 277, 279, 282, 906; 181/224

(56) References Cited

U.S. PATENT DOCUMENTS

| | | | | |
|---|---|---|---|---|
| 1,865,677 A | * | 7/1932 | Cheyney | 138/38 |
| 2,676,678 A | * | 4/1954 | Jacobson | 181/290 |
| 3,831,710 A | | 8/1974 | Wirt | |
| 4,156,352 A | | 5/1979 | Gelbard et al. | |
| 4,316,522 A | * | 2/1982 | Hirschorn | 181/224 |
| 5,007,216 A | | 4/1991 | Pearson | |
| 5,253,486 A | | 10/1993 | Sugahara et al. | |
| 5,543,198 A | | 8/1996 | Wilson | |
| 5,723,831 A | | 3/1998 | Martin et al. | |
| 5,760,349 A | | 6/1998 | Borchers et al. | |
| 5,905,234 A | | 5/1999 | Tsukamoto et al. | |
| 6,041,125 A | | 3/2000 | Nishimura et al. | |
| 6,109,388 A | | 8/2000 | Tsukamoto et al. | |
| 6,124,567 A | | 9/2000 | Feldhausen et al. | |
| 6,295,363 B1 | | 9/2001 | Laak, Jr. et al. | |

FOREIGN PATENT DOCUMENTS

| | | | | |
|---|---|---|---|---|
| JP | 61-190214 | * | 8/1986 | 454/906 |
| JP | 1-139952 | * | 6/1989 | 454/906 |
| JP | 2-176335 | * | 7/1990 | 454/906 |

* cited by examiner

*Primary Examiner*—Harold Joyce
(74) *Attorney, Agent, or Firm*—Gerald E. Helget; Nelson R. Capes; Briggs and Morgan

(57) ABSTRACT

A ventilation duct and methods of ventilation are disclosed. The ventilation duct provides a plurality of inner and outer sound absorbing members. The inner and outer sound absorbing members lying in separate planes with portions of the inner and outer sound absorbing members overlapping one another to inhibit the transmission of sound through the duct. The inner and outer sound absorbing members each including a longitudinal cavity filled with a sound absorbing material and having a plurality of sound transmission passages extending through the members to expose the sound absorbing material to incoming sound waves. In addition, the members may be shaped to have a reverse megaphone effect to further reduce the sound transmitted across the duct.

6 Claims, 3 Drawing Sheets

14
10
12
20
20
12
16

18
22b 20
26
24
22a
22b
22b
22a

DUCT SILENCER

CROSS-REFERENCE TO RELATED APPLICATIONS

The present application is a continuation-in-part of co-pending Provisional Application Ser. No. 60/258,862, filed Dec. 29, 2000 and entitled "Duct Silencer."

BACKGROUND

1. Field of the Invention

The present invention relates to ventilation ducts and, more particularly, to ducts providing both ventilation and noise abatement.

2. Description of the Related Art

Ventilation ducts are frequently incorporated into various structures to allow the ventilation of gases and vapors from the structures or to allow air into the structures. In buildings or structures including machinery or equipment that produce toxic or noxious exhaust, the free flow of air through the ducts can be critical. Further, the ventilation of these structures can be important for cooling the machinery or equipment housed in the structures. Many current ventilation ducts and related ventilation systems have a significant pressure drop as the gases or vapors pass from one side of the duct to the other. This pressure drop is a function of the resistance to the flow of the gases or vapors through the duct and, hence, through the housing which is being ventilated. The resistance to air flow decreases the efficiency that the gases or vapors are ventilated from the structures and, when machinery or equipment producing toxic or noxious exhaust is housed within the structure, the resistance to air flow increases the concentration of toxic or noxious exhaust within the structures. Further, the increased resistance decreases the inflow and outflow air. When the equipment or machinery utilizes a combustion engine, the decreased supply of oxygen resulting from inefficient ventilation can reduce the efficiency of the engines. The inflow of oxygen is particularly important when the combustion engine substantially fills the interior volume of the housing, such as when the housing is integral with heavy machinery, such as, for example, loaders and bulldozers, or when the housing is a substructure on the rooftop of a larger building to house unsightly or noisy equipment, such as, for example, generators. Similarly, the flow of air generally through housings is important for cooling equipment and machinery, such as, for example, air conditioning units and combustion engines. In addition, when a structure is actively rather than passively ventilated, the free flow of air through the ducts is critical for a low pressure drop. A lower pressure drop reduces the load on the fan removing air from the structure. Thus, the more freely the air flows through the ducts of an air inlet, the less powerful the fan has to be to meet its performance requirements. Typically, lower capacity fans are less costly than the higher performance fans and the reduced load on the fan typically results in less wear. Therefore, a need exists for a ventilation duct that provides a limited pressure drop as gases and/or vapors pass through the duct.

Further, noise pollution is a growing problem. Frequently, equipment and machinery are noisy and, in some cases, extremely noisy and therefore, contribute to the problem of noise pollution. The noise from equipment and machinery can be distracting to those working in close proximity to the equipment or machinery. The distraction can reduce the productivity for these individuals and, when extremely noisy, can damage the hearing of individuals regularly exposed to the noise levels. Reduced productivity and injured workers can reduce profitability and may result in expensive lawsuits. In addition, noisy equipment can decrease the ability of workers to communicate with one another when in close proximity to the equipment or machinery. In certain work environments, such as, for example, construction zones or industrial facilities, the inability to effectively communicate potential dangers can result in injury to workers or in some cases the death of a worker or workers. City and/or county codes can also require that noise levels be kept below a certain level for at least a part of the day. To minimize the noise, machinery is frequently isolated within a housing or segregated behind a wall to absorb the sound. However, these housings and walls frequently require ventilation ducts to allow for proper ventilation of the equipment or machinery. Therefore, a need exists for a ventilation duct that inhibits the transmission of sound from one side of the duct to the other side of the duct.

SUMMARY OF THE INVENTION

The present invention meets the above needs and provides additional improvements and advantages that will be recognized by those skilled in the art upon review of the present disclosure. In one aspect, a ventilation duct in accordance with the present invention includes a frame to which is mounted a plurality of inner sound absorbing members and a plural of outer sound absorbing members. The plurality of inner sound absorbing members are secured to the frame within a first plane. The plurality of outer sound absorbing members are secured to the frame within a second plane. The first plane being substantially parallel to the second plane. The outer members are secured in the frame such that at least a portion of each outer members overlaps with at least of portion of an inner member to inhibit the transmission of sound. To further inhibit the transmission of sound across the ventilation duct, each of the inner sound absorbing members and the outer sound absorbing members can define a longitudinal cavity that is filled with a sound absorbing material. The inner sound absorbing member including a plurality of sound transmission passages between the outer surface to the longitudinal cavity to direct sound into the longitudinal cavity for sound abatement by the sound absorbing material with the plurality of sound transmission passages on an inner region of the outer sound absorbing members.

In another aspect of the present invention, a housing includes a ventilation duct. The ventilation duct having a plurality of inner sound absorbing members and a plural of outer sound absorbing members secured to a wall of the housing. The plurality of inner sound absorbing members are secured to the wall within a first plane. The plurality of outer sound absorbing members are secured to the wall within a second plane. The first plane being substantially parallel to the second plane. The outer members are secured in the frame such that at least a portion of each outer members overlaps with at least of portion of an inner member to inhibit the transmission of sound. To further inhibit the transmission of sound across the ventilation duct, each of the inner sound absorbing members and the outer sound absorbing members can define a longitudinal cavity that is filled with a sound absorbing material. The inner sound absorbing member including a plurality of sound transmission passages between the outer surface to the longitudinal cavity to direct sound into the longitudinal cavity for sound abatement by the sound absorbing material with the plurality of sound transmission passages on an inner region of the outer sound absorbing members.

It is thus an object of the present invention to provide novel apparatus and methods for ventilating a structure.

It is further an object of the present invention to provide such novel apparatus and methods that reduces the pressure drop as gases and vapors pass through a ventilation duct.

It is further an object of the present invention to provide such novel apparatus and methods that inhibit the passage of sounds through a ventilation duct.

BRIEF DESCRIPTION OF THE DRAWINGS

The illustrative embodiments may best be described by reference to the accompanying drawings where.

Figure 1:
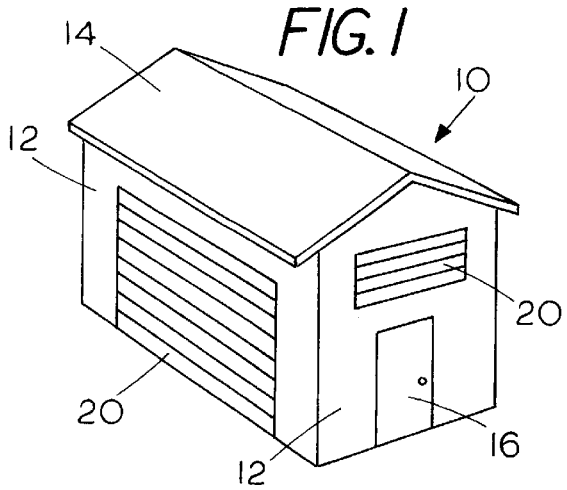
FIG. 1 illustrates a perspective view of an embodiment of a housing in accordance with the present invention.

All Figures are drawn for ease of explanation of the basic teachings of the present invention only; the extensions of the Figures with respect to number, position, relationship and dimensions of the parts to form the preferred embodiment will be explained or will be within the skill of the art after the following description has been read and understood. Further, the exact dimensions and dimensional proportions to conform to specific force, weight, strength, and similar requirements will likewise be within the skill of the art after the following description has been read and understood.

Where used in various Figures of the drawings, the same numerals designate the same or similar parts. Furthermore, when the terms "top," "bottom," "right," "left," "forward," "rear," "first," "second," "inside," "outside," and similar terms are used, the terms should be understood to reference only the structure shown in the drawings as it would appear to a person viewing the drawings and utilized only to facilitate describing the illustrated embodiment.

DETAILED DESCRIPTION OF THE PREFERRED EMBODIMENT

FIG. 1 illustrates an embodiment of a housing 10 in accordance with the present invention. Housing 10 may be configured to house one or more piece of machinery, may be sized to house a plurality of pieces of machinery and workers to operate the machinery, or may be otherwise configured as will be recognized by those skilled in the art. Further, housing 10 may be configured for permanent or temporary placement at a desired location or may be configured for placement on heavy equipment such as, for example, top loaders, bulldozers and cranes. Housing 10 generally includes one or more walls 12 with at least one of walls 12 including a ventilation duct 20. Housing 10 can also include a roof 14. Roof 14 is illustrated as sloped for exemplary purposes only. As illustrated for exemplary purposes, housing 10 includes four walls 12. Typically, when housing 10 includes four walls to form an enclosure, housing 10 will also include a door 16 to provide access to the equipment, machinery or other items housed within housing 10. Walls 12, roof 14 and door 16 are generally constructed to enclose machinery or equipment and may be constructed from materials designed to promote ventilation and/or to retain sound emitted from the equipment or machinery. Ventilation ducts 20 can be sized and positioned within housing 10 to best facilitate ventilation and/or sound abatement. Ventilation ducts 20 are typically positioned within the walls but, may also be positioned in door 16 or roof 14. The specific sizing and positioning of ventilation ducts 20 will depend on the particular application and will be recognized by those skilled in the art upon review of the present disclosure.

Figure 2:
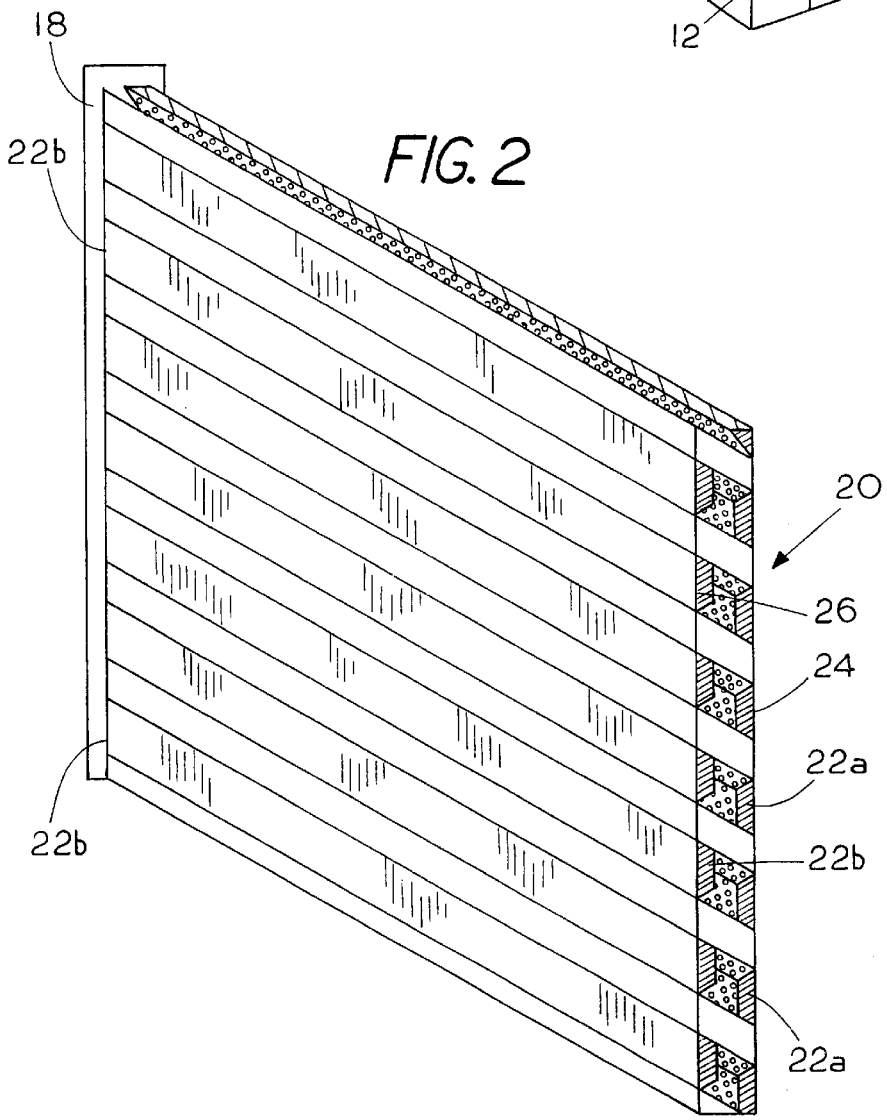
FIG. 2 illustrates a perspective view of an embodiment of an apparatus in accordance with the present invention.

FIG. 2 illustrates a perspective view of an embodiment of a ventilation duct 20 in accordance with the present invention. Ventilation duct 20 of FIG. 2 is shown with the ends of sound absorbing members 22*a* and 22*b* unsecured for illustrative purposes. Typically, sound absorbing members 22*a* and 22*b* are secured to a wall 12 of housing 10 or to a frame 18 to support the sound absorbing members 22*a* and 22*b*. In use, a side plate may be provided to enclose and/or support sound absorbing members 22*a* and 22*b*. Sound absorbing members 22*a* and 22*b* are generally spaced from one another to allow the passage of gases or vapors while minimizing the pressure drop between an inner surface 24 and an outer surface 26 of ventilation duct 20. Generally, ventilation ducts 20 include a plurality of inner sound absorbing members 22*a* substantially positioned with a first plane and a plurality of outer sound absorbing members 22*b* substantially positioned with a second plane. The first plane and the second plane are substantially parallel to one another and spaced from one another along a perpendiculars to both planes. Inner sound absorbing members 22*a* and outer sound absorbing members 22*b* are shown as straight and elongated and with each member arranged in parallel within other members within their respective planes for exemplary purposes only. Inner sound absorbing members 22*a* and outer sound absorbing members 22*b* are generally positioned relative to one another within the inner and outer planes to permit ventilation while inhibiting the transmission of sound between an inner surface 24 and an outer surface 26 of ventilation duct 20. To inhibit the transmission of sound, inner sound absorbing members 22*a* and outer sound absorbing members 22*b* positioned within their respective planes so that there is an continuous overlap 50, best illustrated in FIGS. 3A, 3B and 3C, between at least a portion of outer sound absorbing members 22*b* and inner sound absorbing members 22*a*. Overlap 50 is an overlap of the members in opposing planes along an axis perpendicular to the planes in which the members substantially lie. Thus, overlap 50 inhibits the direct transmission of sound along the perpendicular between inner surface 24 and outer surface 26 of ventilation duct 20.

Figure 3A:
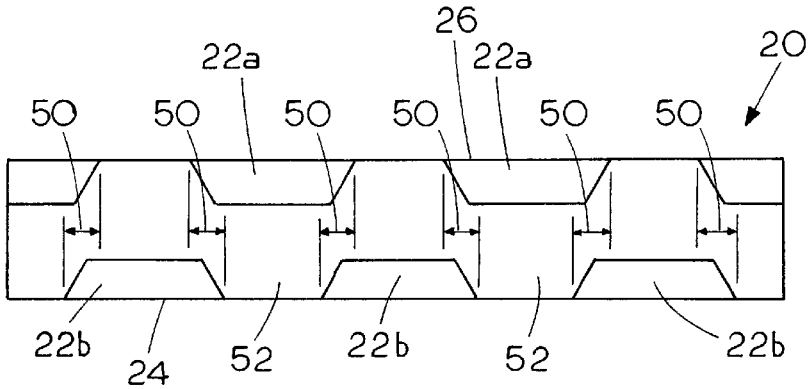
FIG. 3A illustrates a side view in cross-section of an of an embodiment in accordance with the present invention.
Figure 3B:
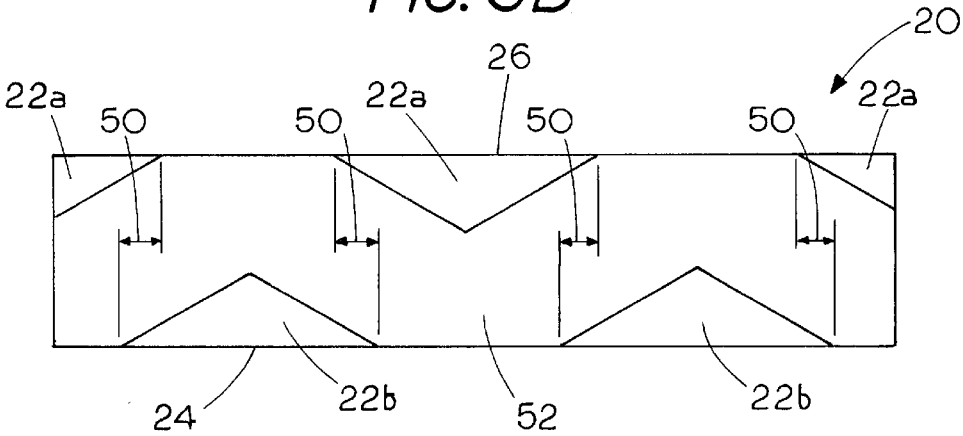
FIG. 3B illustrates a side view in cross-section of another embodiment in accordance with the present invention.
Figure 3C:
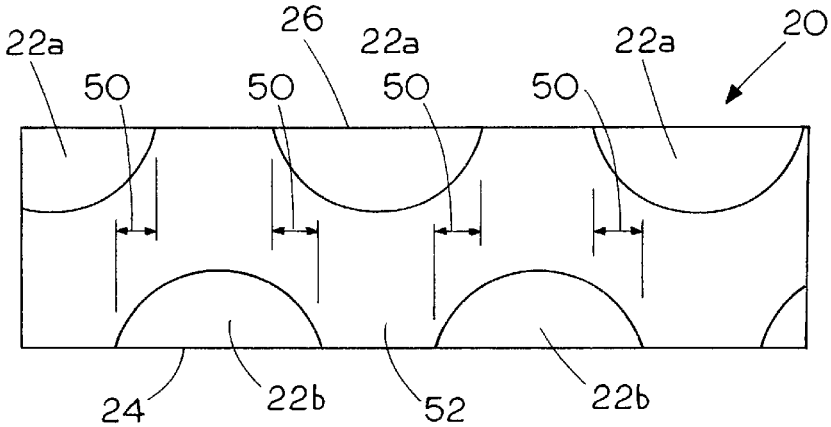
FIG. 3C illustrates a side view in cross-section of yet another embodiment in accordance with the present invention.

The cross-sectional profile of inner sound absorbing members 22*a* and outer sound absorbing members 22*b*, cumulatively referred to as sound absorbing members 22*a* and 22*b*, are generally configured to cooperatively reflect sound toward the inner surface of ventilation duct 20. As illustrated in FIG. 3A, sound absorbing members 22*a* and 22*b* have a trapezoidal cross-section shape. As illustrated in FIG. 3B, sound absorbing members 22*a* and 22*b* have a triangular cross-section shape. As illustrated in FIG. 3C, sound absorbing members 22*a* and 22*b* have a semicircular cross-section shape. Regardless of cross-sectional shape, the sound absorbing members 22*a* and 22*b* are positioned relative to one another to reflect sound originating from the side of inner surface 24 of ventilation duct 20 back toward inner surface 24 side of ventilation duct 20. As illustrated in FIGS. 3A, 3B and 3C, sound absorbing members 22*a* and 22*b* are positioned so that the apexes or shorter sides of the cross-sectional profiles for inner sound absorbing members 22*a* and outer sound absorbing members 22*b* are opposing one another. The positioning of the apexes or shorter sides of the cross-sectional shapes opposing one another as illustrated creates a reverse megaphone effect to further inhibit the transmission of sound across the duct. Further, the sound absorbing members 22*a* and 22*b* are spaced to permit ventilation through ventilation passage 52. Ventilation passage 52 generally being the space within ventilation duct 20 permitting the ventilation of gases or vapors between inner surface 24 and outer surface 26 of ventilation duct 20.

Figure 4A:
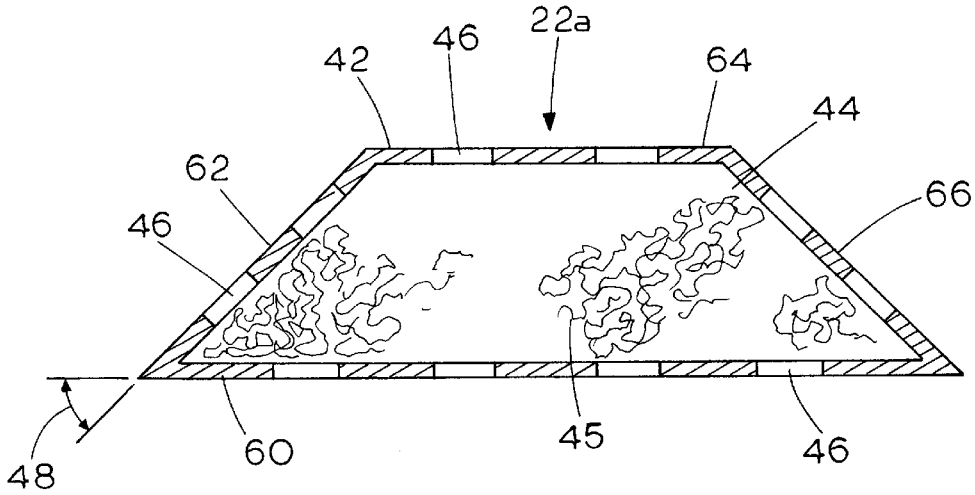
FIG. 4A illustrates a detailed cross-section of an inner sound absorbing member in accordance with the present invention.

FIG. 4A illustrates detailed cross-section of an embodiment of an inner sound absorbing member 22*a* in accordance with the present invention. Inner sound absorbing member 22*a* defines an outer surface 42, a longitudinal cavity 44 and a plurality of sound transmission passage 46. Typically, inner sound absorbing members 22*a* may be constructed materials such as galvanized steel, fiberglass, plastics or other materials capable of withstanding the physical environment which ventilation duct 20 will be exposed. In one aspect, inner sound absorbing members 22*a* may be constructed of a sound absorbing material. Outer surface is illustrated with a trapezoidal cross-section for exemplary purposes. When trapezoidal, the angle 48 at the junction of inside wall 60 and a side wall 62 or 66 may be selected to provide a reverse megaphone effect when positioned in a ventilation duct 20 in accordance with the present invention. To provide the reverse megaphone effect, angle 48 could be, for example, 55 degrees or other angles that will be recognized by those skilled in the art. To further reduce sound transmission, inner sound absorbing members 22*a* may be provided with a plurality of sound transmission passages 46. Sound transmission passages 46 may extend from outer surface 42 of inner sound absorbing members 22*a* to longitudinal cavity 44. Sound transmission passages 46 may be round, square, triangular, irregular or otherwise shaped to permit the passage of sound to the longitudinal cavity 44. Generally, sound transmission passages 46 are positioned and concentrated to absorb the direct and reflected sounds arising from inner surface 24 side of ventilation duct 20. As illustrated, inner sound absorbing members 22*a* includes sound transmission passages 46 on an inside wall 60, a left end wall 62, an outside wall 64 and a right end wall 66. In one aspect, sound transmission passages 46 may be of sufficient size and number to result in an outer surface 42 that is at least 40% open to longitudinal cavity 44. Longitudinal cavity 44 extends for at least a portion of the length of inner sound absorbing members 22*a*. In one aspect, longitudinal cavity 44 may be filled with a sound absorbing material 45. Sound absorbing material 45 may be any number of natural or synthetic materials known to those skilled in the art to effectively absorb sound. For example, sound absorbing material 45 may be such as mineral wool or fiber glass. If mineral wool, the mineral wool could be packed within longitudinal cavity 44 at eight pounds per cubic foot or to otherwise packed to efficiently absorb sound as will be recognized by those skilled in the art upon review of the present disclosure.

Figure 4B:
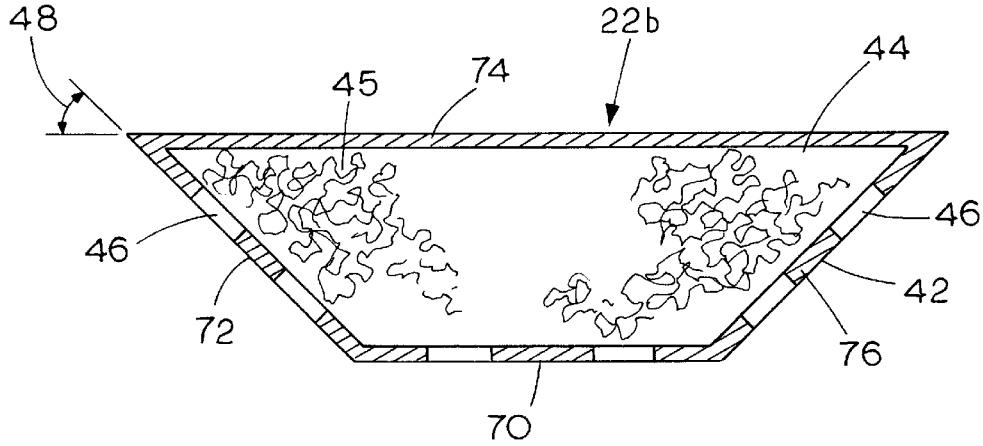
FIG. 4B illustrates a detailed cross-section of an outer sound absorbing member in accordance with the present invention.

FIG. 4B illustrates an embodiment of an outer sound absorbing member 22*b* in accordance with the present invention. Outer sound absorbing member 22*b* defines an outer surface 42, a longitudinal cavity 44 and a plurality of sound transmission passage 46. Typically like inner sound absorbing members 22*a*, outer sound absorbing members 22*b* may be constructed materials such as galvanized steel, fiberglass, plastics or other materials capable of withstanding the physical environment which ventilation duct 20 will be exposed. In one aspect, outer sound absorbing member 22*b* may be constructed of a sound absorbing material. Outer surface is illustrated with a trapezoidal cross-section for exemplary purposes. When trapezoidal, the angle 48 at the junction an outside wall 74 and a side wall 72 or 76 may be selected to provide a reverse megaphone effect when positioned in a ventilation duct 20 in accordance with the present invention. To provide the reverse megaphone effect, angle 48 could be, for example, 55 degrees or other angles that will be recognized by those skilled in the art. To further reduce sound transmission, outer sound absorbing member 22*b* may be provided with a plurality of sound transmission passages 46 as described with respect to inner sound absorbing member 22*a*. Generally, sound transmission passages 46 for outer sound absorbing member 22*b* are also positioned and concentrated to absorb the direct and reflected sounds arising from inner surface 24 side of ventilation duct 20. As illustrated, outer sound absorbing member 22*b* includes sound transmission passages 46 on an inside wall 70, a left end wall 72, and a right end wall 76. Collectively, inside wall 70, a left end wall 72, and a right end wall 76 of outer sound absorbing member 22*b* are referred to as an inner region of outer sound absorbing member 22*b*. In one aspect, sound transmission passages 46 may be of sufficient size and number to result in outer surface 42 of the inner region of outer sound absorbing member 22*b* having at least 40% open to longitudinal cavity 44. As with inner sound absorbing member 22*a*, longitudinal cavity 44 of outer sound absorbing member 22*b* extends for at least a portion of the length of outer sound absorbing member 22*b*. Also like inner sound absorbing member 22*a*, longitudinal cavity 44 of outer sound absorbing member 22*b* may be filled with a sound absorbing material 45 as described above.

Since the invention disclosed above may be embodied in other specific forms without departing from the spirit or general characteristics of the invention, some of which forms have been indicated, the embodiments described in the present disclosure are to be considered in all respects illustrative and not restrictive. The scope of the invention is to be indicated by the appended claims, rather than by the above description, and all changes which come within the meaning and range of equivalency of the claims are intended to be embraced by the claims.

What is claimed is:

1. A ventilation duct, comprising:

a frame;

at least one of inner sound absorbing member secured to the frame within a first plane, the inner sound absorbing members defining a first outer surface and a first longitudinal cavity, the first longitudinal cavity filled with a sound absorbing material, and a first plurality of sound transmission passages in the first outer surface to direct sound into the first longitudinal cavity for sound abatement by the sound absorbing material;

at least one outer sound absorbing member secured to the frame within a second plane with the first plane being substantially parallel to the second plane and the outer members secured in the frame such that at least a portion of each outer members overlaps with at least of portion of an inner member to inhibit the transmission of sound, and the outer sound absorbing members defining a second longitudinal cavity, the second longitudinal cavity filled with the sound absorbing material, and a second plurality of sound transmission passages in a second outer surface to direct sound into the second longitudinal cavity for sound abatement by the sound absorbing material with the second plurality of sound transmission passages on an inner region of the outer sound absorbing members, wherein the inner sound absorbing member and the outer sound absorbing member have opposed apexes.

2. A ventilation duct, as in claim 1, further comprising the at least one inner sound absorbing members and the at least one outer sound absorbing members configured to have a reverse megaphone effect on sound traveling across the at least one inner sound absorbing members and the at least one outer sound absorbing members.

3. A ventilation duct, as in claim 2, further comprising the at least one inner sound absorbing members and the at least one outer sound absorbing members having a cross-sectional shape selected from the group consisting of trapezoidal, triangular or semi-circular.

4. A sound abatement housing, comprising:

at least one wall;

a ventilation duct secured within the wall to permit ventilation through the wall, the ventilation duct, comprising at least one inner sound absorbing member secured to the wall within a first plane, the inner sound absorbing members defining a first outer surface and a first longitudinal cavity, the first longitudinal cavity filled with a sound absorbing material, and a first plurality of sound transmission passages in the first outer surface to direct sound into the first longitudinal cavity for sound abatement by the sound absorbing material, at least one outer sound absorbing members secured to the wall within a second plane with the first plane being substantially parallel to the second plane and the outer members secured in the wall such that at least a portion of each outer members overlaps with at least of portion of an inner member to inhibit the transmission of sound, and the outer sound absorbing members defining a second longitudinal cavity, the second longitudinal cavity filled with the sound absorbing material, and a second plurality of sound transmission passages in the second outer surface to direct sound into the second longitudinal cavity for sound abatement by the sound absorbing material with the plurality of sound transmission passages on an inner region of the outer sound absorbing members, wherein the inner sound absorbing member and the outer sound absorbing member have opposed apexes.

5. A ventilation duct, as in claim 3, further comprising the at least one inner sound absorbing members and the at least one outer sound absorbing members configured to have a reverse megaphone effect on sound traveling across the at least one inner sound absorbing members and the plurality of outer sound absorbing members.

6. A ventilation duct, as in claim 5, further comprising the at least one inner sound absorbing members and the at least one outer sound absorbing members having a cross-sectional shape selected from the group consisting of trapezoidal, triangular or semi-circular.

* * * * *